US012031340B1

(12) United States Patent
Magnusen et al.

(10) Patent No.: US 12,031,340 B1
(45) Date of Patent: Jul. 9, 2024

(54) SUPPORT WALER AND METHOD OF STRIKING FORMWORK

(71) Applicant: PERI Formwork Systems, Inc., Elkridge, MD (US)

(72) Inventors: David Magnusen, Chicago, IL (US); Brad Keown, Elkridge, MD (US)

(73) Assignee: PERI Formwork Systems, Inc., Elkridge, MD (US)

( * ) Notice: Subject to any disclaimer, the term of this patent is extended or adjusted under 35 U.S.C. 154(b) by 110 days.

(21) Appl. No.: 17/567,843

(22) Filed: Jan. 3, 2022

(51) Int. Cl.
*E04G 13/02* (2006.01)
*E04G 17/04* (2006.01)
*E04G 17/00* (2006.01)

(52) U.S. Cl.
CPC ..... *E04G 17/047* (2013.01); *E04G 13/021* (2013.01); *E04G 2017/008* (2013.01)

(58) Field of Classification Search
CPC ..... E04G 13/02; E04G 13/021; E04G 11/10; E04G 11/12; E04G 11/16; E04G 17/04; E04G 17/045; E04G 17/14; E04G 17/047; E04G 2017/008
See application file for complete search history.

(56) References Cited

U.S. PATENT DOCUMENTS

| | | | |
|---|---|---|---|
| 3,795,393 | A | 3/1974 | Melfi |
| 3,899,152 | A | 8/1975 | Avery |
| 3,945,601 | A | 3/1976 | Rowley |
| 4,033,544 | A | 7/1977 | Johnston |
| 4,144,690 | A | 3/1979 | Avery |
| 4,787,183 | A | 11/1988 | Johnston |
| 4,976,401 | A | 12/1990 | Carlson |
| 6,581,898 | B2 | 6/2003 | McCracken |
| 6,840,490 | B2 | 1/2005 | Caluisi |
| 7,100,344 | B2 | 9/2006 | Schlenker |
| 7,665,259 | B2 | 2/2010 | Yoon |
| D648,866 | S | 11/2011 | D'Anglade |
| 8,651,449 | B2 | 2/2014 | Au |
| 2009/0084930 | A1 | 4/2009 | Ball |
| 2015/0218831 | A1 | 8/2015 | Berger |
| 2015/0267421 | A1 | 9/2015 | Berger |

FOREIGN PATENT DOCUMENTS

| | | | |
|---|---|---|---|
| CA | 2110342 | A1 | 5/1995 |
| CA | 2141463 | A1 | 8/1996 |
| CA | 2178031 | A1 | 12/1997 |
| CA | 2179084 | A1 | 12/1997 |
| CA | 2206191 | A1 | 11/1998 |
| CN | 202441052 | U | 9/2012 |
| CN | 102877643 | B | 1/2013 |

(Continued)

*Primary Examiner* — Michael Safavi
(74) *Attorney, Agent, or Firm* — SLEMAN & LUND LLP

(57) ABSTRACT

A formwork assembly including a plurality of formwork elements defining a concrete-receiving space, at least one of the plurality of formwork elements comprising a first panel, at least one support waler configured to receive at least one vertical fixation element and comprising a second panel, a horizontal fixation element configured to engage with the first panel and the second panel such that rotation of the horizontal fixation element allows for the at least one vertical fixation element to be freely removed from the at least one support waler after curing of concrete in the concrete-receiving space.

20 Claims, 11 Drawing Sheets

(56) References Cited

FOREIGN PATENT DOCUMENTS

| | | | | | |
|---|---|---|---|---|---|
| CN | 104675108 | A | | 6/2015 | |
| CN | 106907002 | A | | 6/2017 | |
| CN | 206903213 | U | | 1/2018 | |
| CN | 112065045 | A | * | 12/2020 | ..... E04G 17/047 |
| CN | 112696016 | A | * | 4/2021 | ..... E04G 17/047 |
| DE | 2635565 | A1 | | 2/1978 | |
| DE | 4417466 | A1 | | 10/1995 | |
| DE | 19758276 | A1 | | 7/1999 | |
| EP | 0048624 | A2 | | 3/1982 | |
| EP | 0049096 | B1 | | 4/1982 | |
| EP | 0062420 | B1 | | 10/1982 | |
| EP | 1479852 | A1 | | 11/2004 | |
| EP | 1990483 | A2 | | 11/2008 | |
| EP | 2712980 | A2 | | 4/2014 | |
| EP | 3170952 | A1 | | 5/2017 | |
| FR | 2780743 | A1 | | 1/2000 | |
| JP | 2657390 | B2 | | 11/1989 | |
| JP | 2920308 | B2 | | 12/1991 | |
| JP | H03295979 | A | | 12/1991 | |
| JP | 4164117 | B1 | | 10/2008 | |
| KR | 20010002727 | A | * | 1/2001 | |
| KR | 20040096927 | A | * | 11/2004 | ..... E04G 17/0757 |
| KR | 100860831 | B1 | * | 9/2008 | ..... E04G 13/025 |
| KR | 20090039439 | A | * | 4/2009 | ..... E04G 17/047 |
| KR | 101035423 | B1 | | 12/2010 | |
| KR | 20110114121 | A | * | 10/2011 | ..... E04G 13/02 |
| KR | 101097836 | B1 | * | 12/2011 | ..... E04G 17/047 |
| KR | 101139014 | B1 | * | 4/2012 | ..... E04G 13/025 |
| KR | 20120057207 | A | * | 6/2012 | ..... E04G 11/06 |
| KR | 101308581 | B1 | * | 9/2013 | ..... E04G 13/02 |
| KR | 1641334 | B1 | * | 7/2016 | ..... E04G 13/021 |
| KR | 1722021 | B1 | * | 4/2017 | ..... E04G 13/02 |
| KR | 1803487 | B1 | * | 11/2017 | ..... E04G 17/02 |
| KR | 2095821 | B1 | * | 4/2020 | ..... E04G 13/021 |
| RU | 15745 | U1 | | 11/2000 | |
| WO | WO-2006057145 | A1 | * | 6/2006 | ..... E04G 11/10 |
| WO | 2010074550 | A1 | | 7/2010 | |
| WO | 2016139513 | A1 | | 9/2016 | |

* cited by examiner

SUPPORT WALER AND METHOD OF STRIKING FORMWORK

FIELD OF THE INVENTION

The present application relates to a column formwork support waler for a formwork assembly.

BACKGROUND OF THE INVENTION

In certain systems, column formwork are used to construct concrete structures. In some implementations, when the concrete is poured, an increased amount of strain (e.g., hoop strain in the case of curved formwork) is exerted at the seams of the formwork elements. This increased strain at the seams makes it difficult to strike the formwork from the concrete structure.

SUMMARY OF THE INVENTION

The present application overcomes the disadvantages of the prior art by providing a support waler that allows for easier striking in formwork system, thereby providing a safer worksite.

One aspect of the disclosure provides a formwork assembly, comprising: a plurality of formwork elements defining a concrete-receiving space, at least one of the plurality of formwork elements comprising a first panel; at least one support waler configured to receive at least one vertical fixation element and comprising a second panel; and a horizontal fixation element configured to engage with the first panel and the second panel such that rotation of the horizontal fixation element allows for the at least one vertical fixation element to be freely removed from the at least one support waler after curing of concrete in the concrete-receiving space.

In one example, the first panel defines a first panel hole.

In one example, the second panel of the at least one support waler comprises defines a second panel hole corresponding to the first panel hole.

In one example, the horizontal fixation element is configured to engage with the first panel hole and the second panel hole.

In one example, the at least one support waler comprises a waler fixed to the second panel.

In one example, the waler defines at least one vertical hole configured to receive the at least one vertical fixation element.

In one example, the at least one vertical hole comprises two vertical holes arranged on a first portion of the waler adjacent to the second panel.

In one example, the at least one vertical hole comprises three vertical holes arranged on a second portion of the waler distal from the second panel.

In one example, the at least one fixation element comprises a pin, a bolt, or a wedge.

In one example, the concrete-receiving space defines a cross sectional shape, the cross sectional shape being at least one of elliptical, circular, rectangular, or square.

In one example, rotation of the horizontal fixation element causes relative deflection of the first panel or the second panel toward or away from each other, thereby relieving pressure on at least one of the vertical fixation elements and allowing at least one of the plurality of vertical fixation elements to be freely removed after curing of the fresh concrete.

In one example, the plurality of formwork elements comprise at least four formwork elements.

In one example, the at least one support waler comprises a first plurality of support walers arranged vertically with respect to a seam defined between two adjacent formwork elements such that each of the first plurality of support walers span the seam defined between the two adjacent formwork elements.

In one example, the support waler is secured within a horizontal space defined by at least two walers of the plurality of formwork elements such that the support waler does not extend beyond a perimeter of the plurality of formwork elements.

In one example, at least one of: the first panel hole is threaded and the second panel hole is unthreaded; or the first panel hole and the second panel hole are not threaded, and the horizontal fixation element is configured to engaged with a nut welded to a rear portion of the first panel.

In one example, the support waler spans a seam defined between adjacent formwork elements.

Another aspect of the disclosure provides a method of striking a formwork assembly, comprising: engaging at least one support waler with at least one formwork element via at least one vertical fixation element; engaging a horizontal fixation element with a first panel of the at least one formwork element and a second panel of the support waler; pouring fresh concrete into a concrete-receiving space defined by the at least one formwork element; rotating the horizontal fixation element such that a portion of the support waler deflects; freely removing the at least one vertical fixation element from the at least one formwork element based upon the deflection of the portion of the support waler.

In one example, rotating the horizontal fixation element causes the first panel and the second panel to deflect toward or away from each other.

In one example, the method further includes subsequently rotating the horizontal fixation element after freely removing the first vertical pin; and freely removing at least a second vertical pin from the at least one formwork element.

In one example, the method further includes subsequently rotating the horizontal fixation element after freely removing the second vertical pin; and freely removing at least a third vertical pin from the at least one formwork element.

In one example, the method further includes removing the support waler from the at least one formwork element; and removing the at least one formwork element from the cured concrete.

Another aspect of the disclosure provides a formwork assembly, comprising: a plurality of formwork elements defining a concrete-receiving space, at least one of the plurality of formwork elements comprising a first panel; at least one support waler comprising a second panel and a waler fixed to the second panel, the support waler being securable within a horizontal space defined by at least two walers of the plurality of formwork elements such that the support waler spans a seam defined between adjacent formwork elements.

BRIEF DESCRIPTION OF THE DRAWINGS

The invention description below refers to the accompanying drawings, of which.

DETAILED DESCRIPTION

Figure 1:
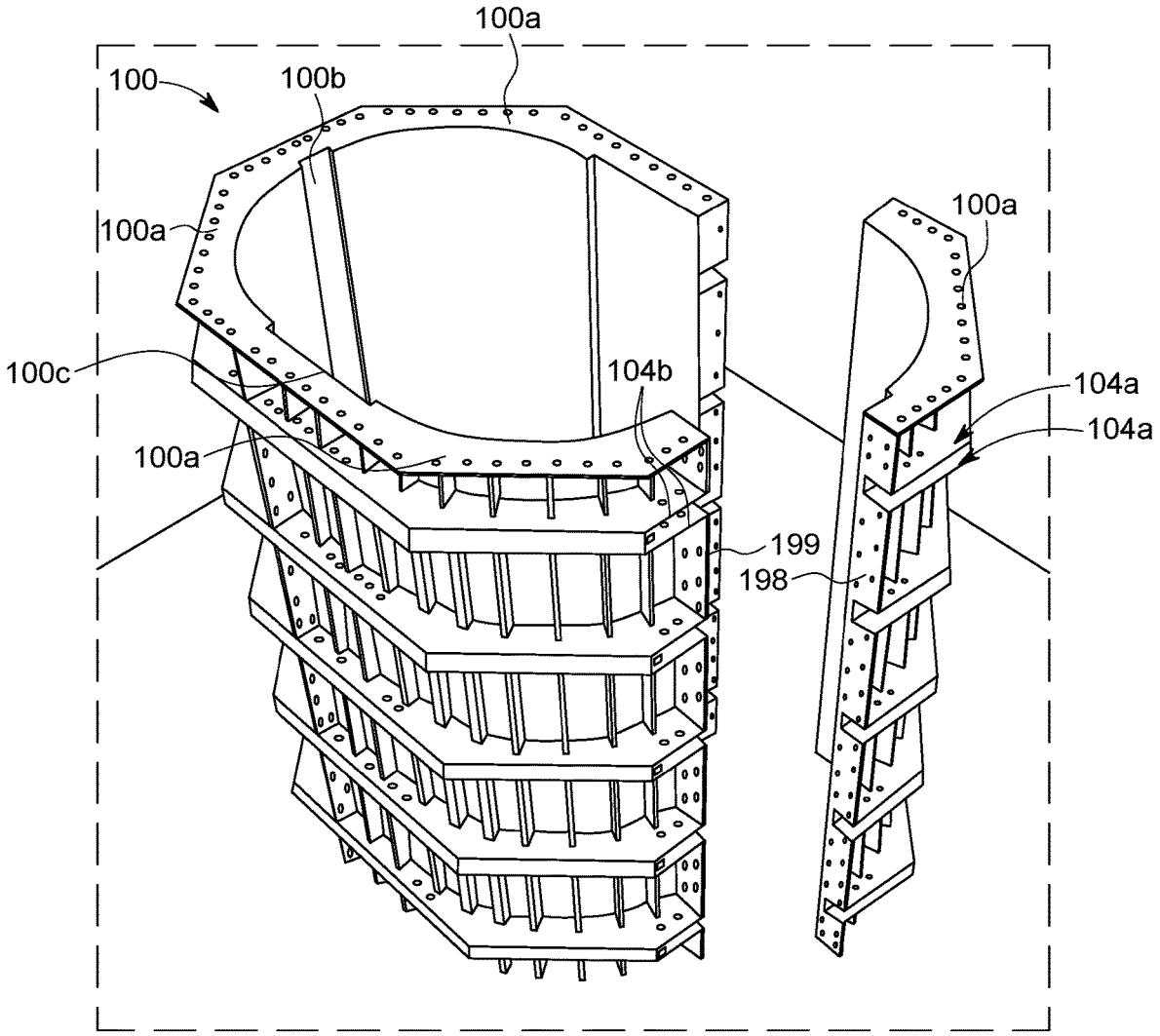
FIGS. 1-1F depict various stages of a method of forming a concrete structure according to one or more aspects of the disclosure.
Figure 1A:
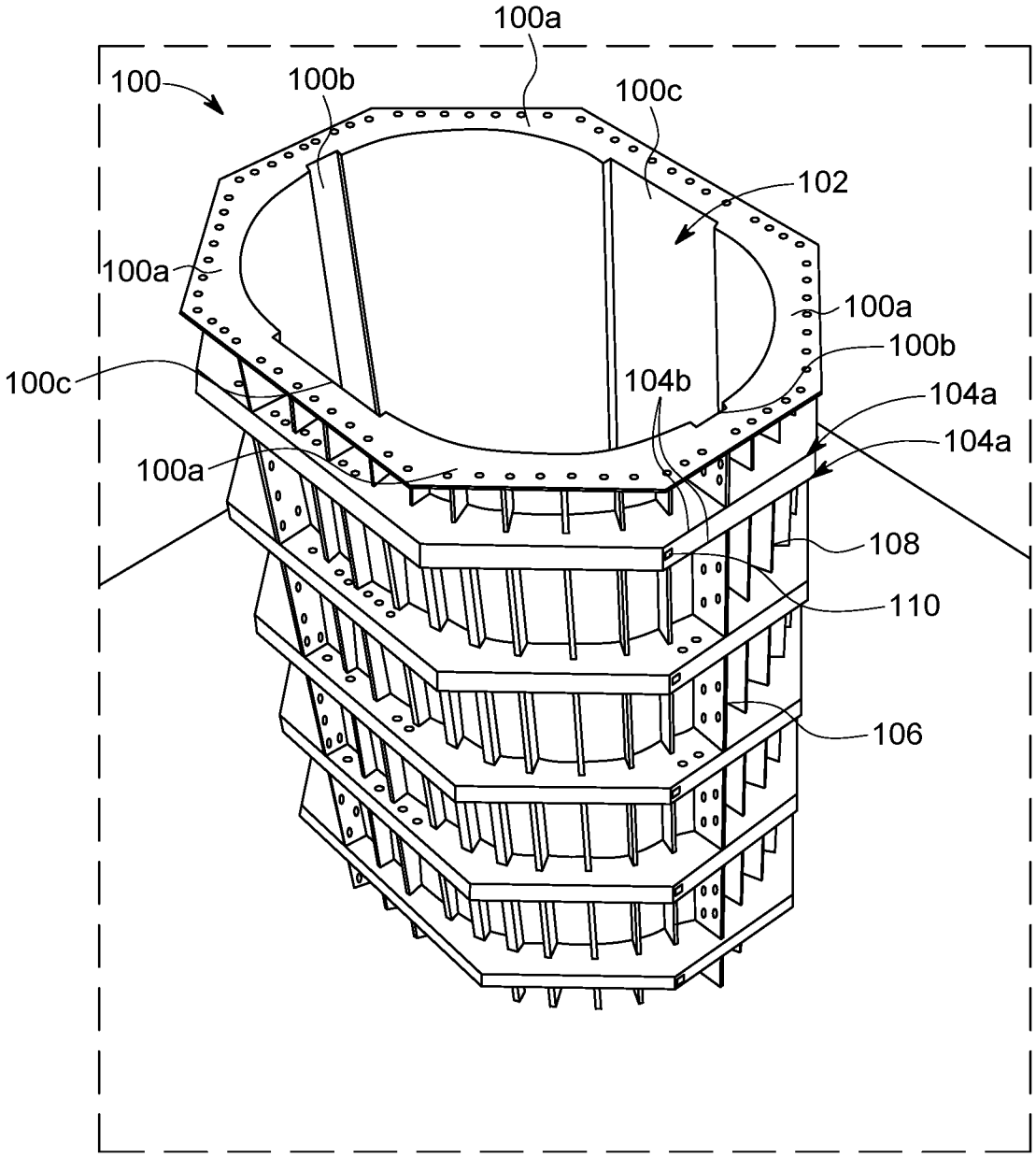
Figure 1B:
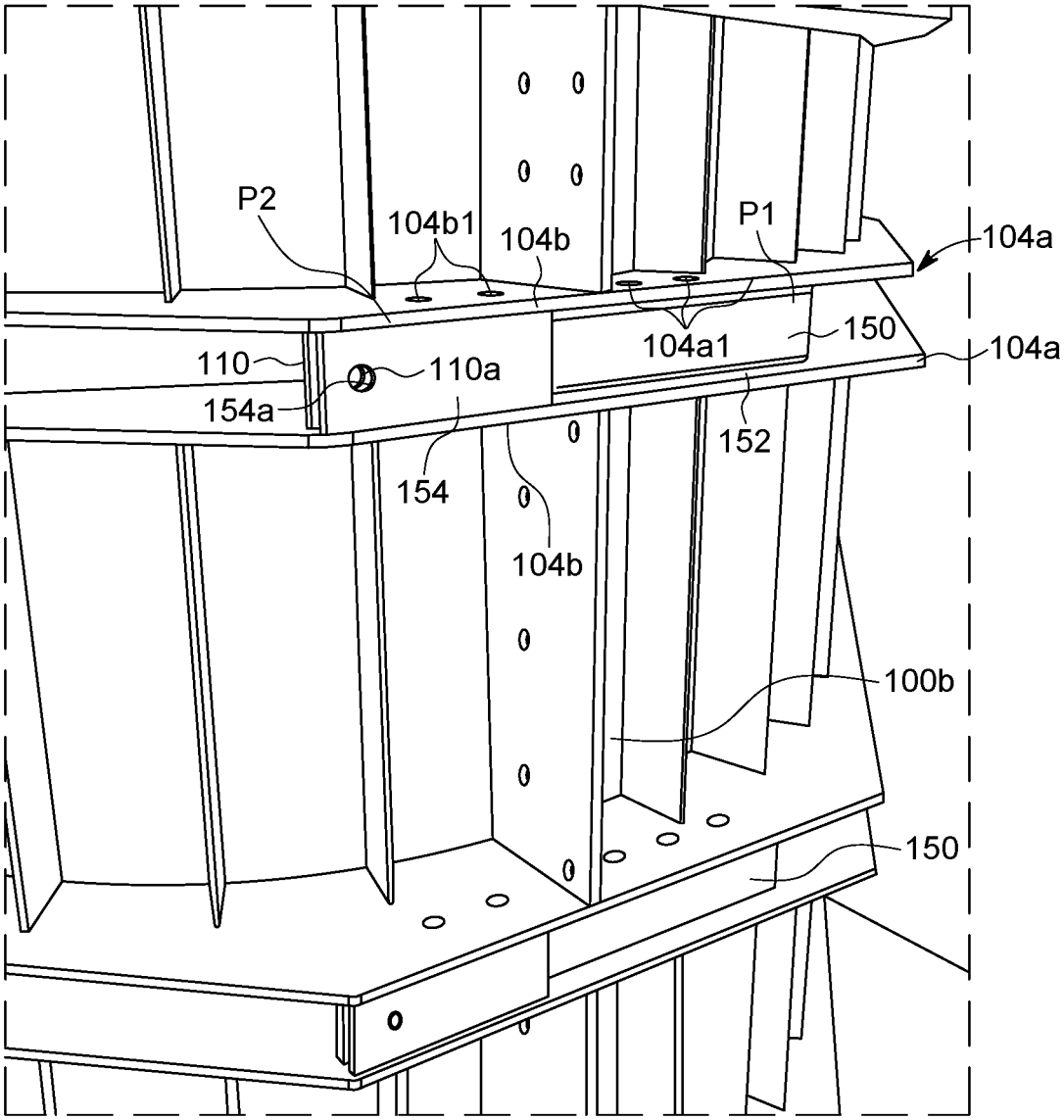
Figure 1C:
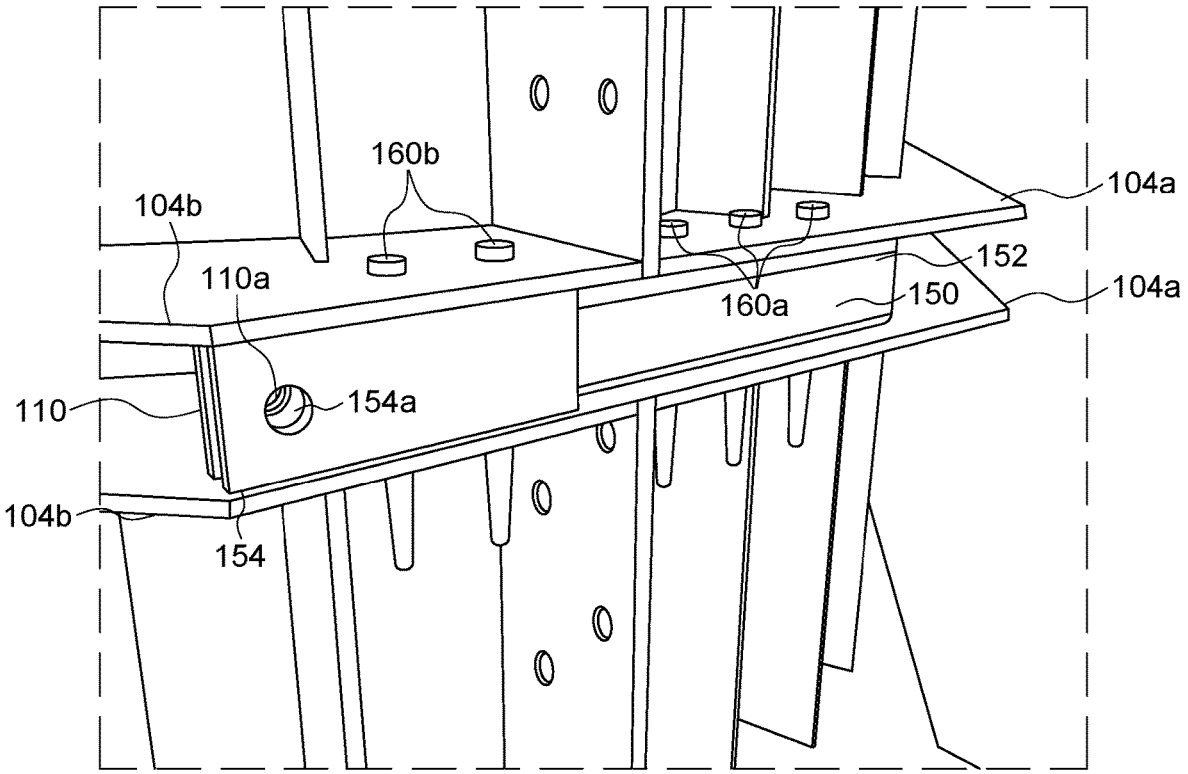
Figure 1D:
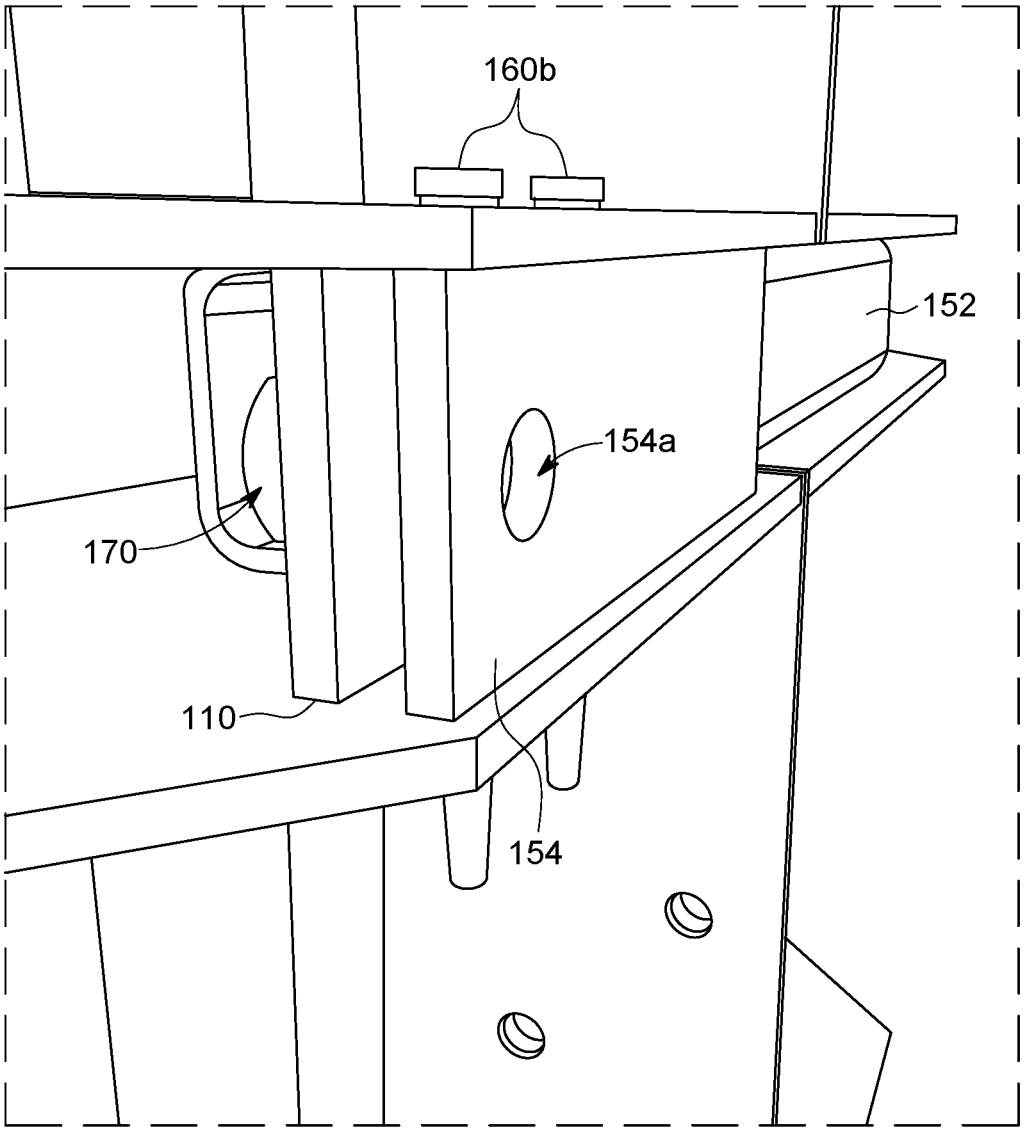
Figure 1E:
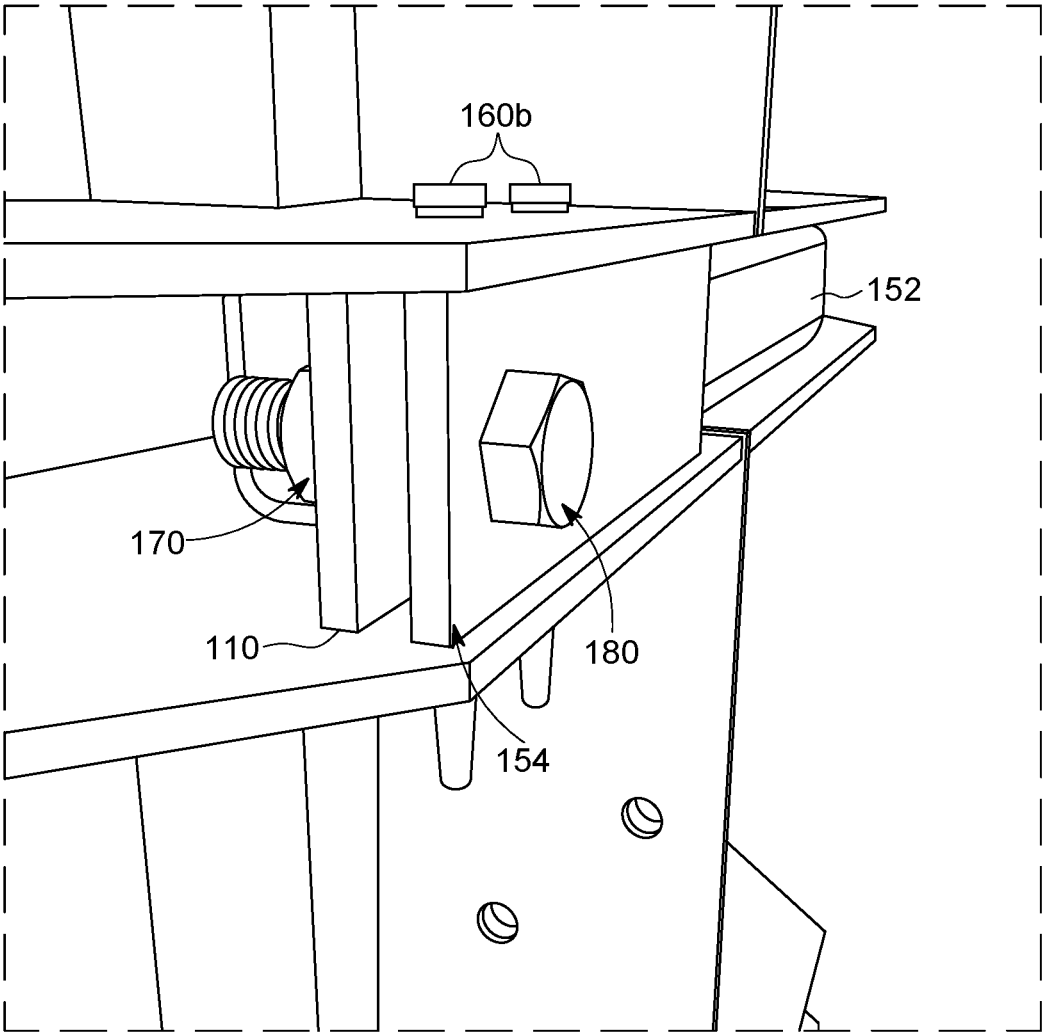
Figure 1F:
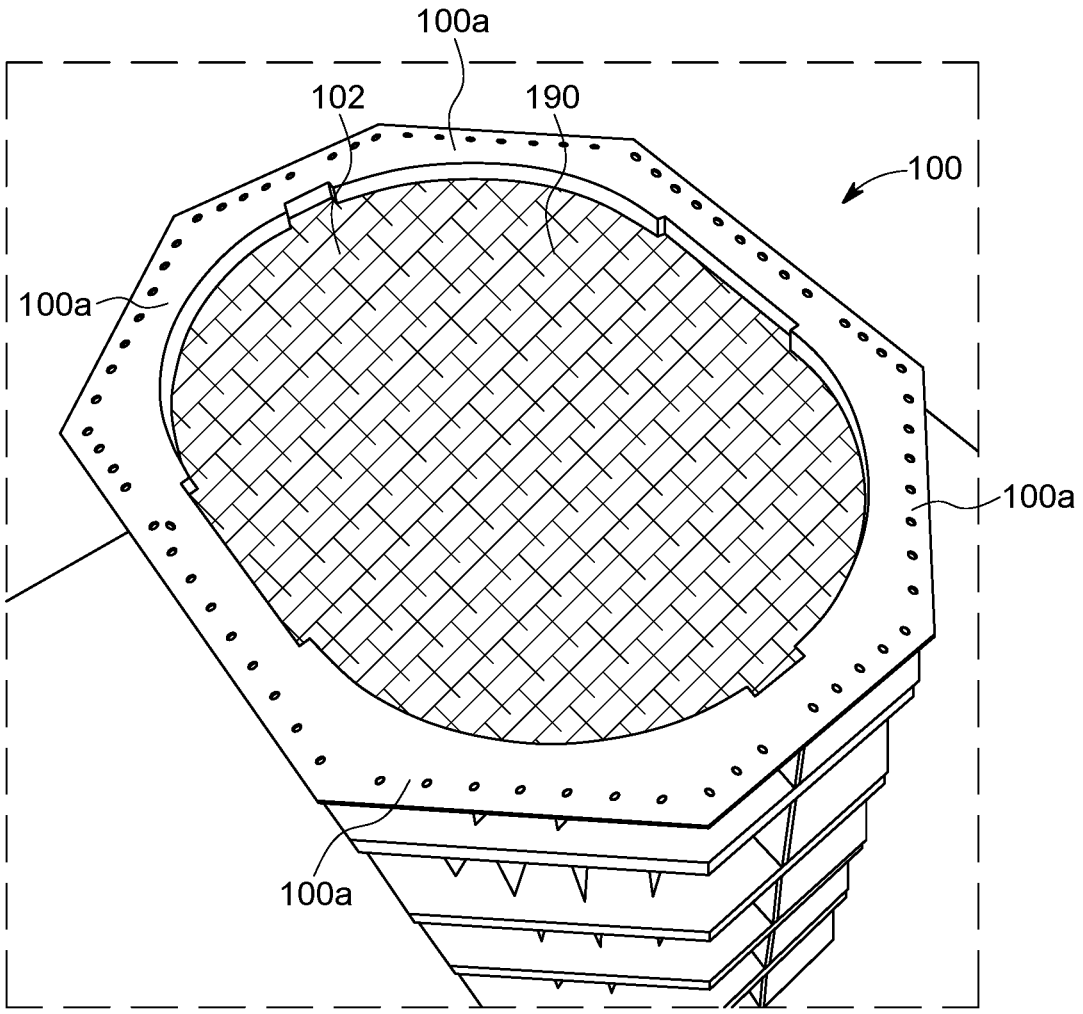

FIGS. 1-1F depict various stages of a method of forming a concrete structure according to one or more aspects of the disclosure.

FIG. 1 depicts an exploded perspective view of formwork assembly 100 according to one or more aspects of the disclosure and FIG. 1A depicts a perspective view of formwork assembly 100 according to one or more aspects of the disclosure. The formwork assembly 100 can include a plurality of formwork elements 100*a* that have concrete-facing surfaces to define a concrete-receiving space 102. In the example of FIG. 1A, the formwork elements 100*a* have generally curved concrete-facing surfaces, while in other examples of the present application the concrete-facing surfaces can be planar, substantially planar, or any combination of curved and/or planar. The formwork elements 100*a* can include column formwork elements, also referred to as column formwork panels. In another example, the formwork elements 100*a* can include wall formwork elements, also referred to as wall formwork panels.

As depicted in FIGS. 1 and 1A, the formwork elements 100*a* interengage at seams 100*b, c* defined between adjacent formwork elements 100*a* where a side rail 198 of a first formwork element 100*a* meets with and abuts a side rail 199 of a second formwork element 100*a* to form the overall formwork assembly 100. The seams 100*b* extend vertically and are opposed to one another and the seams 100*c* extend vertically and are opposed to one another. While FIGS. 1 and 1A depict two pairs of opposing seams 100*b,c*, formwork assembly 100 may define any number of opposing seams, including at least one pair of opposing seams (for example in a formwork assembly defining reduced-diameter columns). In the example of FIGS. 1 and 1A, the formwork assembly 100 includes four formwork elements 100*a* and generally defines a concrete-receiving space 102 having an oval-shaped cross-sectional profile for receiving poured concrete to form a corresponding oval-shaped concrete structure. In other examples, the number of formwork elements 100*a* can be any number to define the formwork assembly 100. In still other examples, the formwork assembly 100 and the formwork elements 100*a* can define other shaped concrete-receiving space(s) 102, such as elliptical, circular, rectangular, square or any other type of shape having a combination flat or rounded portion, depending on the desired shape of the concrete structure. For example, the concrete structure could be one or more of a column, wall, or any other type of structure.

The formwork assembly 100 can define a plurality of walers 104*a, b* extending generally horizontally, first vertical stiffeners 106 (formed where a side rail 198 of a first formwork element 100*a* meets with and abuts a side rail 199 of a second formwork element 100*a*) that generally define the seam 100*b* between adjacent formwork elements 100*a*, and second vertical stiffeners 108 between vertically arranged walers 104*a, b*. In one example, the walers 104*a* are associated with a first formwork element 100*a* and the walers 104*b* are associated with a second formwork element 100*a* (as depicted in the exploded view of FIG. 1), but walers 104*a, b* are substantially continuous across the seam 100*b* when the formwork assembly 100 and the formwork elements 100*a* are assembled (as depicted in FIG. 1A). Disposed between the walers 104*a, b* can be a panel 110 that defines a panel hole 110*a*. The walers 104 near the seams 100*b* are generally shorter in length than the walers 104 near the seams 100*c* by virtue of the ovular shape of the formwork assembly 100.

FIG. 1B depicts a plurality of support walers 150 (also referred to as supporting walers) arranged relative to walers 104*a, b* such that the support walers 150 align with the panel 110 and the hole 110*a*. As depicted, the plurality of support walers 150 are arranged vertically with respect to the seam such that each of the plurality support walers 150 span the seam. Any number of vertically arranged support walers 150 can be provided, depending on the configuration of the formwork elements 100*a*.

As depicted, the support waler 150 is disposed in a horizontal space between walers 104*a, b* and overlaps with and spans across a seam 100*b* and comprises a waler 152 and a panel 154, with the waler 152 connected to a panel 154 that defines a hole 154*a*. The waler 152 can define a longitudinal axis from a first portion P1 (or first end) to a second portion P2 (or second end), with the second end P2 having the panel 154 attached thereto. When the support waler 150 is placed between walers 104*a, b*, the panel hole 154*a* aligns with 110*a* and a space is defined between the panel 110 and the panel 154.

Figure 3:
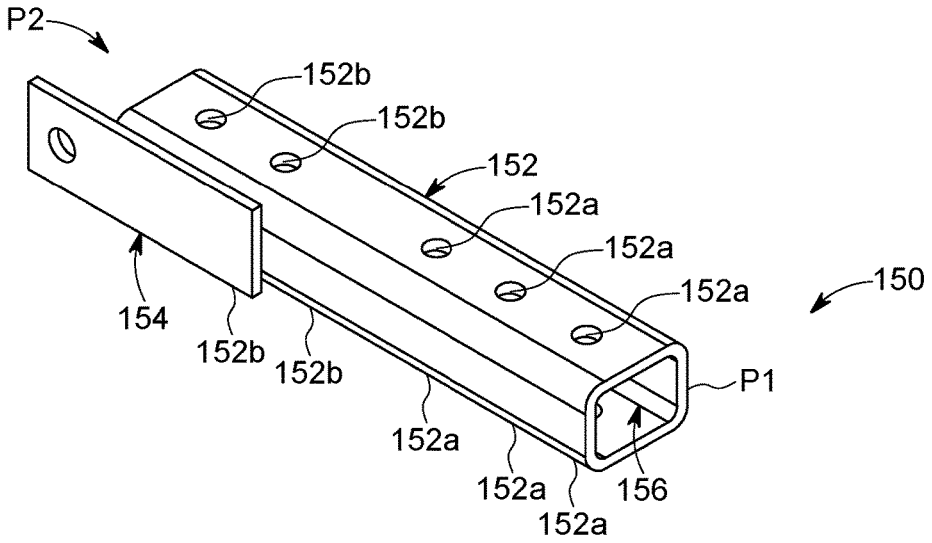
FIG. 3 is a perspective view of the support waler depicted in FIGS. 1A-1F and 2A-2C.

The waler 152 can have a generally rectangular or square cross-section (e.g., with rounded edges) as depicted in FIG. 3, thereby defining a hollow space 156. The panel 154 is welded or otherwise permanently fixed to the waler 152, with the panel 154 extending beyond the second end of the waler 152.

The waler 152 can define a plurality of holes 152*a, b* at a top and bottom surface that, when the waler 152 is arranged in the horizontal space between the walers 104*a, b*, align with holes 104*a*1 in the walers 104*a, b*, as shown in FIG. 3 below. The waler 152 can define a first group of holes 152*a* and a second group of holes 152*b*, with the first group being arranged at a first end and the second group being arranged at the second end of the waler 152 near the panel 154.

FIG. 1C depicts a plurality of vertical fixation elements 160*a, b* engaged with the walers 104*a, b* and the waler 152. In this regard, the vertical fixation elements 160*a* are received by holes 104*a*1 defined by the waler 104*a* and first group of holes 152*a* defined by the waler 152, and the vertical fixation elements 160*b* are received by holes 104*b*1 defined by the waler 104*b* and second group of holes 152*b* defined by the waler 152. This secures the support waler 150 relative to walers 104*a, b*. The vertical fixation elements 160*a, b* can be one or more pins and/or one or more wedges.

FIG. 1D is another view of the panel 154 and panel 110, depicting a nut 170 on a rear side of the panel 110 that faces the formwork element 100*a*. The nut 170 is permanently fixed (e.g., welded) to the panel 110 and has internal threading configured to engage with a horizontal fixation element (such as a bolt) inserted through holes 154*a* and 110*a*, thus securing the horizontal fixation element relative to the panels 110 and 154. In this example, the holes 110*a* and 154 are not threaded, while in other examples, either one or both of the holes 154*a*, 110*a* are threaded and the nut 170 may be omitted.

FIG. 1E depicts the horizontal fixation element 180 engaged with the panels 110 and 154 and the nut 170. In the example of FIG. 1E, the horizontal fixation element 180 comprises a bolt, but in other examples could include a screw, etc. The horizontal fixation element 180 is tightened until the tension from the horizontal fixation element 180 prevents vertical fixation elements 160*b* from being freely removed from the holes 104*b*1 and holes 152*b*. In this regard, the tension from the horizontal fixation element 180 causes waler 152 to compress and a relative deflection of panels 110 and 154 toward one another, thereby reducing the space between the panels 110, 154. In one example, the panel 154 deflects toward panel 110. In another example, panel 110 deflects toward panel 154. In yet another example, panels 110 and 154 simultaneously deflect toward one another. In this configuration, the support waler 150 does not extend beyond a perimeter of the plurality formwork elements 100*a*, thereby not affecting the horizontal clearance of the overall formwork assembly 100.

FIG. 1F depicts pouring of fresh concrete 190 into the space 102.

Figure 2A:
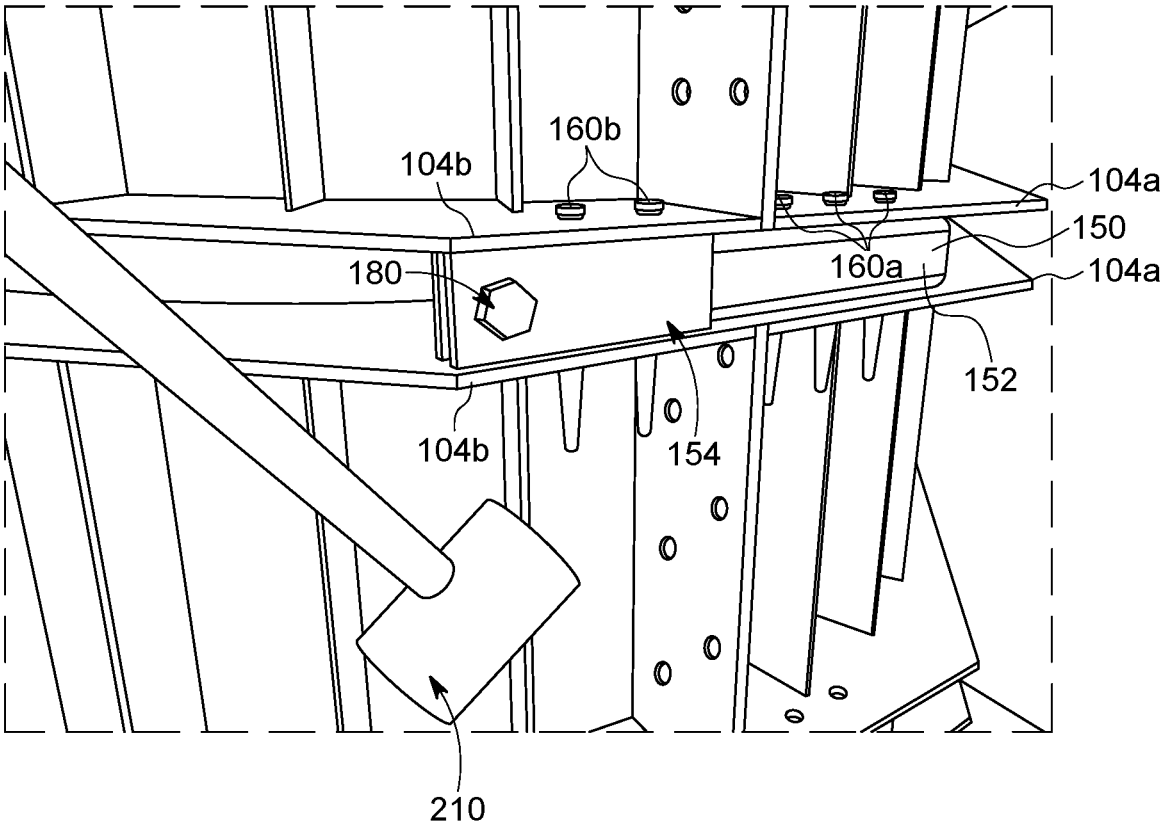
FIGS. 2A-2C depict various stages of a method of striking formwork according to one or more aspects of the disclosure.
Figure 2B:
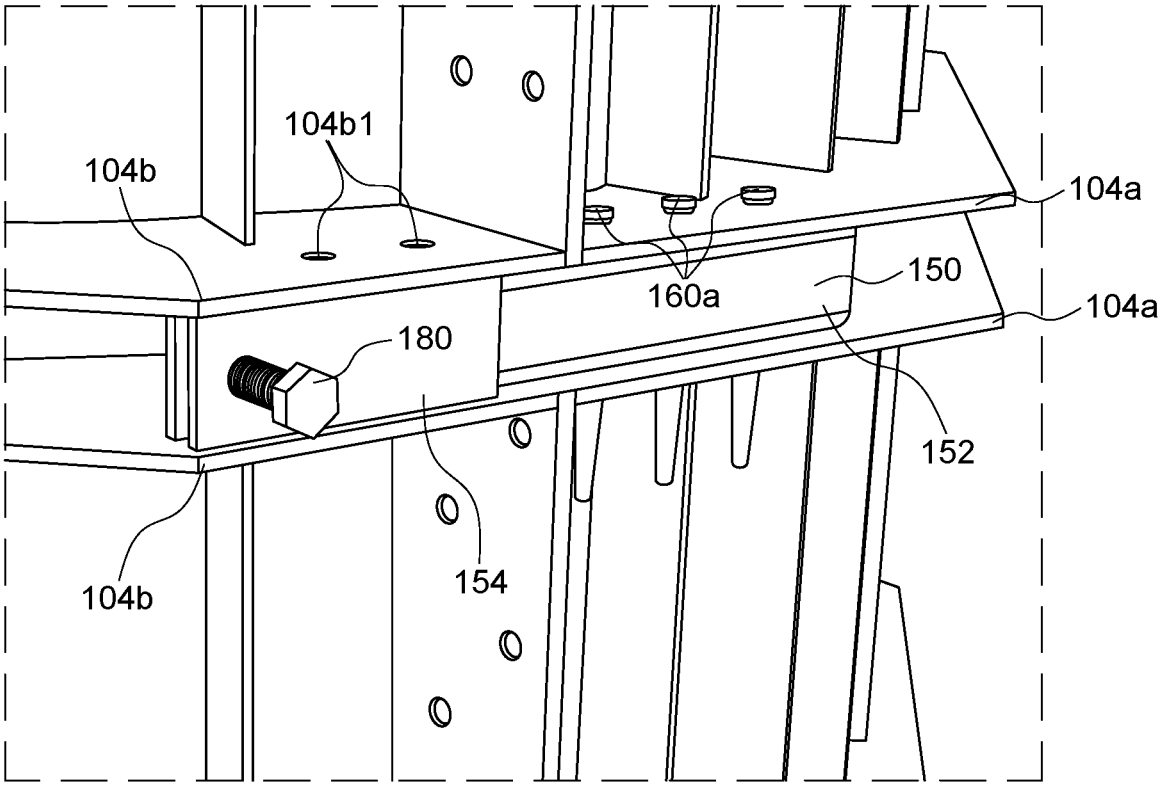
Figure 2C:
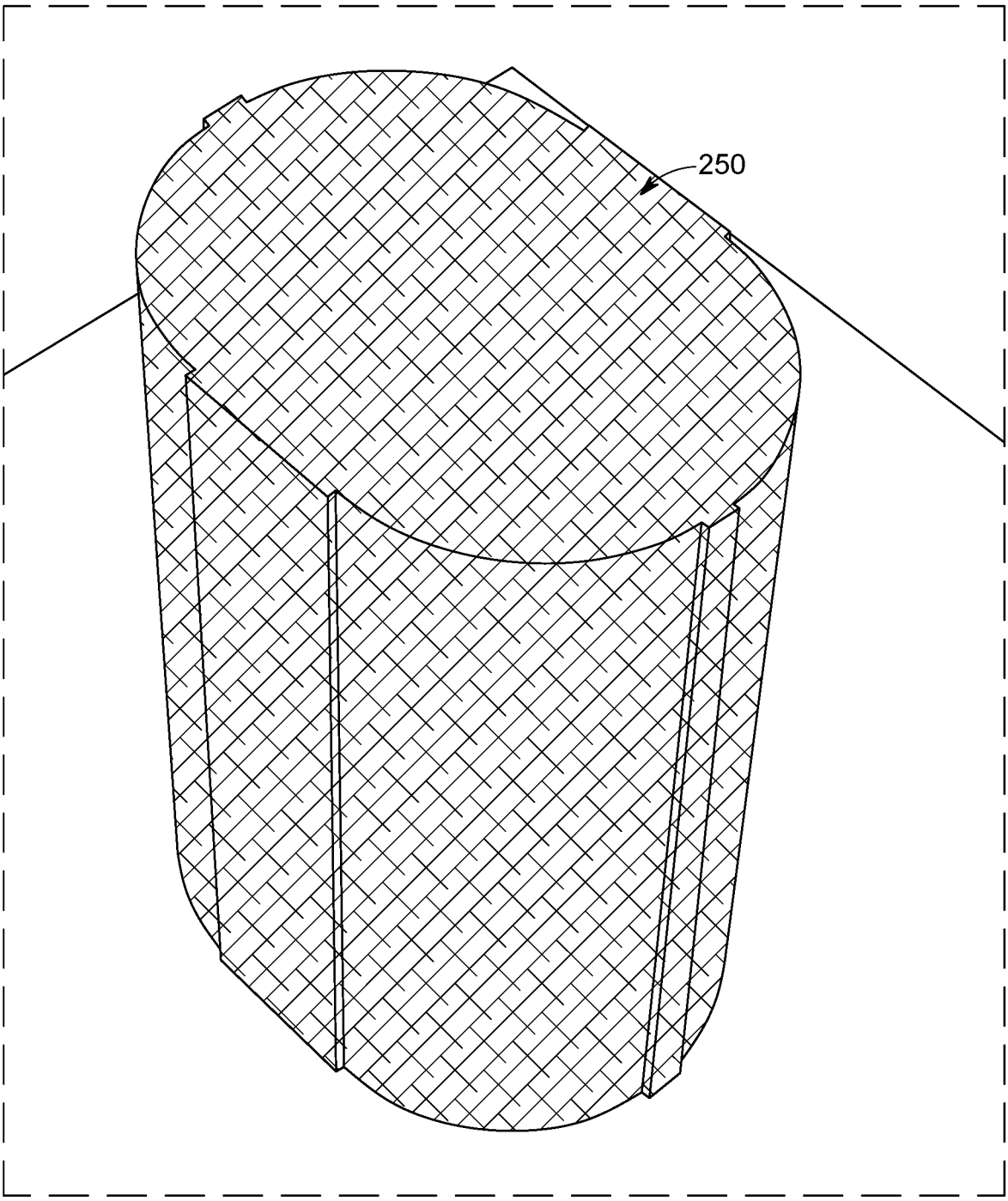

FIGS. 2A-2C depict various stages of a method of striking formwork according to one or more aspects of the disclosure.

FIG. 2A depicts removal of the vertical fixation element 160*b* closest to the bolt 180. To accomplish this, the horizontal fixation element 180 is disengaged (e.g., loosened by rotation) such that the waler 152 expands and two panels 110 and 154 can relatively deflect away from one another. In one example, the panel 154 deflects away panel 110. In another example, panel 110 deflects away panel 154. In yet another example, panels 110 and 154 simultaneously deflect away from one another. In the example where the horizontal fixation element 180 is a bolt, this is done by rotating the bolt. This deflection relieves the strain on the vertical fixation element 160*b*, thus allowing it to be freely removed vertically relative to hole 104*b*1 and hole 152*b*. This can be done by a hammer 210 or any other force providing tool.

After the first vertical fixation element 160*b* is removed, the horizontal fixation element 180 is further disengaged (e.g., further loosened by rotated) again such that the second vertical fixation 160*b* element is loosened. Alternatively, the first and second vertical fixation elements 160*b* can both be removed after a first disengagement of the horizontal fixation element 180 such that a second further disengagement of the horizontal fixation element 180 is not necessary. The second fixation element 160*b* is removed manually (e.g., by hammer 210.) This process can continue depending on the number of vertical fixation elements 160*b* present.

FIG. 2B depicts removal of the horizontal fixation element 180. Once the fixation elements 160*b* are removed, the horizontal fixation element 180 can be completely removed from the panels 110, 154. Once removed, the vertical fixation elements 160*a* can be freely removed. Once the horizontal fixation element 180 and the vertical fixation elements 160*a* are removed, the support waler 150 can be removed from the formwork elements 100*a*, thus allowing the formwork elements 100*a* to be removed (stricken) from the concrete structure 250.

FIG. 2C depicts the formwork elements 100*a* having been stricken (e.g., removed) from the concrete structure 250.

FIG. 3 is a perspective view of the support waler 150 depicted in FIGS. 1A-1F and 2A-2C.

Figure 4:
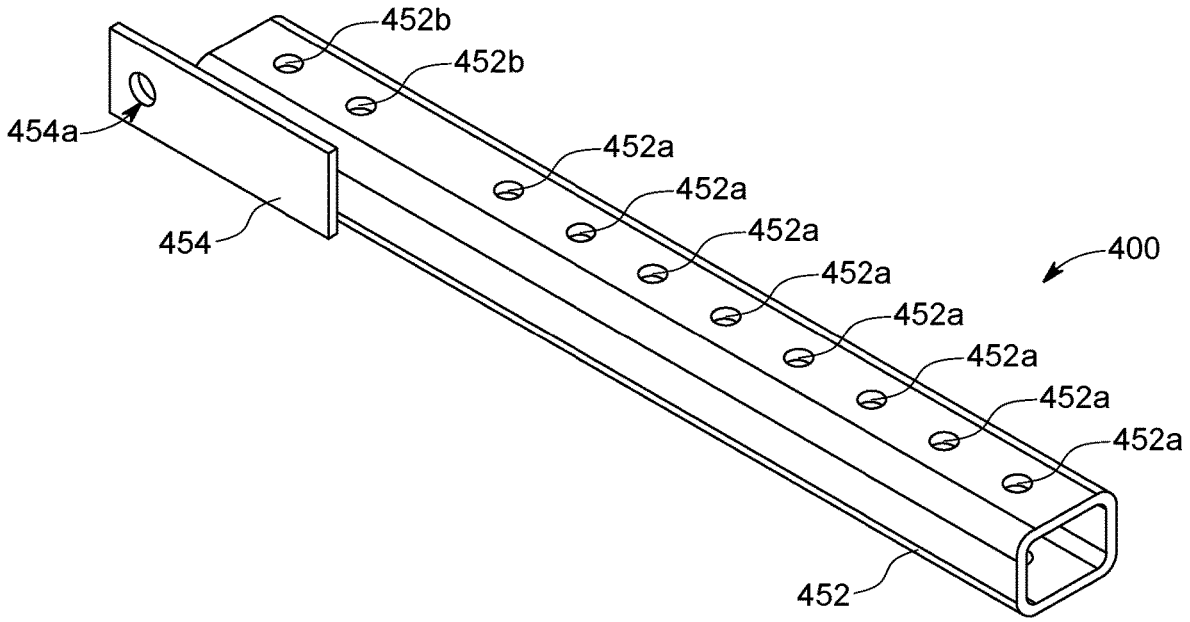
FIG. 4 is a perspective view of a support waler according to another aspect of the disclosure.

FIG. 4 is a perspective view of a support waler 400 according to another aspect of the disclosure. In this example, the support waler 400 includes a waler 452 that defines a first group of eight holes 452*a*, a second group of two holes 452*b* and has a greater length than the waler 152 of support waler 150. The support waler 400 can also include a panel 454 and hole 454*a* similar to support waler 150. In one example, the support waler 400 can be used on seams 100*c* (e.g., along the long axis of the ovular formwork elements 100*a*) and the support waler 150 can be used on seams 100*b* (e.g., along the short axis of the formwork elements 100*a*).

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A formwork assembly, comprising:

a plurality of formwork elements defining a concrete-receiving space, at least one of the plurality of formwork elements comprising a first panel defining a first panel hole;

at least one support waler configured to receive at least one vertical fixation element and comprising a second panel defining a second panel hole corresponding to the first panel hole; and a horizontal fixation element configured to engage with the first panel and the second panel such that rotation of the horizontal fixation element allows for the at least one vertical fixation element to be freely removed from the at least one support waler after curing of concrete in the concrete-receiving space, wherein at least one of:

the first panel hole is threaded and the second panel hole is unthreaded; or the first panel hole and the second panel hole are not threaded, and the horizontal fixation element is configured to engaged with a nut arranged on a rear portion of the first panel.

2. The assembly of claim 1, wherein the horizontal fixation element is configured to engage with the first panel hole and the second panel hole.

3. The assembly of claim 1, wherein the at least one support waler comprises a waler fixed to the second panel.

4. The assembly of claim 3, wherein the waler defines at least one vertical hole configured to receive the at least one vertical fixation element.

5. The assembly of claim 4, wherein the at least one vertical hole comprises two vertical holes arranged on a first portion of the waler adjacent to the second panel.

6. The assembly of claim 5, wherein the at least one vertical hole comprises three vertical holes arranged on a second portion of the waler distal from the second panel.

7. The assembly of claim 5, wherein the at least one fixation element comprises a pin, a bolt, or a wedge.

8. The assembly of claim 1, wherein the concrete-receiving space defines a cross sectional shape, the cross sectional shape being at least one of elliptical, circular, rectangular, or square.

9. The assembly of claim 1, wherein rotation of the horizontal fixation element causes relative deflection of the first panel or the second panel toward or away from each other, thereby relieving pressure on at least one of the vertical fixation elements and allowing at least one of the plurality of vertical fixation elements to be freely removed after curing of the fresh concrete.

10. The assembly of claim 1, wherein the plurality of formwork elements comprise at least four formwork elements.

11. The assembly of claim 1, wherein the at least one support waler comprises a first plurality of support walers arranged vertically with respect to a seam defined between two adjacent formwork elements such that each of the first plurality of support walers span the seam defined between the two adjacent formwork elements.

12. The assembly of claim 1, wherein the support waler is secured within a horizontal space defined by at least two walers of the plurality of formwork elements such that the support waler does not extend beyond a perimeter of the plurality of formwork elements.

13. The assembly of claim 1, wherein the nut is welded to the rear portion of the first panel.

14. The assembly of claim 1, wherein the support waler spans a seam defined between adjacent formwork elements.

15. A method of striking a formwork assembly, comprising:

engaging at least one support waler with at least one formwork element via at least one vertical fixation element;

engaging a horizontal fixation element with a first panel of the at least one formwork element and a second panel of the support waler;

pouring fresh concrete into a concrete-receiving space defined by the at least one formwork element;

rotating the horizontal fixation element such that a portion of the support waler deflects;

freely removing the at least one vertical fixation element from the at least one formwork element based upon the deflection of the portion of the support waler;

subsequently rotating the horizontal fixation element after freely removing the first vertical pin; and freely removing at least a second vertical pin from the at least one formwork element.

16. The method of claim 15, wherein rotating the horizontal fixation element causes the first panel and the second panel to deflect toward or away from each other.

17. The method of claim 15, further comprising:

subsequently rotating the horizontal fixation element after freely removing the second vertical pin; and freely removing at least a third vertical pin from the at least one formwork element.

18. The method of claim 15, further comprising:

removing the support waler from the at least one formwork element; and removing the at least one formwork element from the cured concrete.

19. A formwork assembly, comprising:

a plurality of formwork elements, at least a portion of one of the plurality of formwork elements being curved such that the plurality of formwork elements defines an at least partially curved concrete-receiving space, at least one of the plurality of formwork elements comprising a first panel, at least two adjacent formwork elements of the plurality of formwork elements defining a seam where side rails of the at least two adjacent formwork elements meet and abut;

at least one support waler comprising a second panel and a waler fixed to the second panel, the support waler being securable within a horizontal space defined by at least two walers of the plurality of formwork elements such that the waler of the support waler spans the seam defined between adjacent formwork elements.

20. The assembly of claim 19, wherein the at least one support waler is secured within a horizontal space defined by at least two walers of the plurality of formwork elements such that the at least one support waler does not extend beyond a perimeter of the plurality of formwork elements.

* * * * *